US009548148B2

(12) United States Patent
Kunieda et al.

(10) Patent No.: US 9,548,148 B2
(45) Date of Patent: Jan. 17, 2017

(54) R-T-B BASED SINTERED MAGNET

(71) Applicant: TDK CORPORATION, Tokyo (JP)

(72) Inventors: Ryota Kunieda, Tokyo (JP); Takuma Hayakawa, Tokyo (JP); Tetsuya Chiba, Tokyo (JP); Kenichi Nishikawa, Tokyo (JP); Yoshinori Fujikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 285 days.

(21) Appl. No.: 14/354,865

(22) PCT Filed: Oct. 4, 2012

(86) PCT No.: PCT/JP2012/075740

§ 371 (c)(1),
(2) Date: Apr. 28, 2014

(87) PCT Pub. No.: WO2013/061744

PCT Pub. Date: May 2, 2013

(65) Prior Publication Data

US 2014/0283649 A1 Sep. 25, 2014

(30) Foreign Application Priority Data

Oct. 28, 2011 (JP) ..... 2011-236617
Sep. 26, 2012 (JP) ..... 2012-212333

(51) Int. Cl.
*H01F 1/053* (2006.01)
*C22C 19/07* (2006.01)
(Continued)

(52) U.S. Cl.
CPC ..... *H01F 1/0536* (2013.01); *C22C 19/07* (2013.01); *C22C 38/001* (2013.01);
(Continued)

(58) Field of Classification Search
None
See application file for complete search history.

(56) References Cited

U.S. PATENT DOCUMENTS

2006/0231165 A1 10/2006 Kato et al.
2009/0019969 A1 1/2009 Kato et al.
(Continued)

FOREIGN PATENT DOCUMENTS

CN 1698142 A 11/2005
JP B2-5-10806 2/1993
(Continued)

OTHER PUBLICATIONS

Written Opinion issued in International Patent Application No. PCT/JP2012/075740 dated Jan. 15, 2013.
(Continued)

*Primary Examiner* — Jessee Roe
*Assistant Examiner* — Christopher Kessler
(74) *Attorney, Agent, or Firm* — Oliff PLC

(57) ABSTRACT

An R-T-B based sintered magnet maintains high magnetic properties and decreases usage of heavy rare earth elements. The magnet includes main phase grains and grain boundary phases, the main phase grain containing a core portion and a shell portion. X in the main phase LR(2-x)HRxT14B of the core portion ranges from 0.00 to 0.07; x in the main phase LR(2-x)HRxT14B of the shell portion ranges from 0.02 to 0.40; and the maximum thickness of the shell portion ranges from 7 nm to 100 nm. LR contains Nd and one or more light rare earth elements consisting of Y, La, Ce, Pr and Sm; HR contains Dy or/and Tb and one or more heavy rare earth elements consisting of Gd, Ho, Er, Tm, Yb and Lu; T contains Fe or/and Co and one or two kinds of Mn and Ni; and B represents boron partly replaced by C (carbon).

11 Claims, 5 Drawing Sheets

(51) Int. Cl.

| | |
|---|---|
| ***H01F 1/057*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| *C22C 33/02* | (2006.01) |

(52) U.S. Cl.
CPC ..... *C22C 38/005* (2013.01); *C22C 38/06* (2013.01); *C22C 38/10* (2013.01); *C22C 38/16* (2013.01); *H01F 1/0577* (2013.01); *C22C 33/02* (2013.01); *C22C 2202/02* (2013.01)

(56) References Cited

U.S. PATENT DOCUMENTS

| | | | | |
|---|---|---|---|---|
| 2010/0040501 | A1 | 2/2010 | Kato et al. | |
| 2011/0262297 | A1* | 10/2011 | Ishii | B22F 1/0014 419/23 |
| 2012/0112863 | A1 | 5/2012 | Kuniyoshi | |
| 2013/0009503 | A1* | 1/2013 | Iwasaki | C21D 6/00 310/152 |
| 2013/0026870 | A1* | 1/2013 | Baba | C22C 38/005 310/152 |

FOREIGN PATENT DOCUMENTS

| | | | | |
|---|---|---|---|---|
| JP | A-7-122413 | | 5/1995 | |
| JP | A-2009-010305 | | 1/2009 | |
| JP | 2011-211069 | A | 10/2011 | |
| JP | A-2011-211071 | | 10/2011 | |
| JP | WO 2011122667 | A1 * | 10/2011 | C22C 38/005 |
| WO | WO 2006/098204 | A1 | 9/2006 | |
| WO | WO 2011/007758 | A1 | 1/2011 | |

OTHER PUBLICATIONS

International Preliminary Report on Patentability issued in International Patent Application No. PCT/JP2012/075740 dated Apr. 24, 2014.

* cited by examiner

R-T-B BASED SINTERED MAGNET

The present invention relates to an R-T-B based sintered magnet (R is Y (yttrium) and one or two or more rare earth elements, T is one or two or more transition metal elements and contains Fe or the combination of Fe and Co as the essential, and B is boron with part of it replaced with C (carbon)).

BACKGROUND

The rare earth based permanent magnets, especially R-T-B based sintered magnets, are widely used in various electric equipments because of exhibiting excellent magnetic properties. However, several technical problems to be solved exist in the R-T-B based sintered magnets with excellent magnetic properties. One of the problems is that coercivity significantly decreases accompanied with increase in temperature due to low thermal stability. Therefore, the coercivity at room temperature can be elevated by the addition of heavy rare earth elements with Dy, Tb and Ho as the representative. Thus, as disclosed in Patent Document 1 (JP5-10806), even if the coercivity decreases as temperature rises, it will be enough for use. Compared to the $R_2T_{14}B$ compound using light rare earth elements such as Nd, Pr and the like, the $R_2T_{14}B$ compound with the addition of these heavy rare earth elements has a high magnetic anisotropy field and can obtain a high coercivity.

The R-T-B based sintered magnet consists of the main phase crystal grains and the sintered body, wherein the main phase crystal grain is composed of the $R_2T_{14}B$ compound, and the sintered body at least comprises a grain boundary phase containing more amount of R than the main phase. In Patent Document 2 (JP7-122413) and Patent Document 3 (WO2006/098204), the optimal concentration distribution of the heavy rare earth elements in the main phase crystal grains which greatly affects the magnetic properties has been disclosed as well as the control method thereof.

It is said in Patent Document 2 that in the rare earth based permanent magnet with the main phase, which has the $R_2T_{14}B$ compound (R represents one or two or more rare earth elements, and T represents one or two or more transition metals) as the main body, and the R-rich phases (R represents one or two or more rare earth elements) as the main constituent phases, the heavy rare earth elements are distributed at a high concentration in at least three sites of the main phase grains. The R-T-B based sintered magnet disclosed in Patent Document 2 was obtained by respectively pulverizing a R-T-B based alloy with the $R_2T_{14}B$ compound as the main constituent phase and a R-T based alloy with a area ratio of R-T eutectic crystal being 50% or less which contains at least one kind of heavy rare earth elements, then mixing, molding and sintering the molded body. This R-T-B based alloy preferably has the $R_2T_{14}B$ compound as the main constituent phase, and such a composition is recommended as 27 wt % (mass %)≤R≤30 wt % (mass %), 1.0 wt % (mass %)≤B≤1.2 wt % (mass %) and T of the balance.

Patent Document 3 has disclosed that an R-T-B based sintered magnet can be obtained with both a high residual flux density and a high coercivity if the following conditions are satisfied. That is, the crystal grain contains the $R_2T_{14}B$ compound as the main body and comprises at least one of Dy and Tb, which are heavy rare earth elements, and at least one of Nd and Pr, which are light rare earth elements; the crystal grain also has a core-shell structure comprising a inner shell portion and a outer shell portion that covers the inner shell portion; in the crystal grain, the concentration of the heavy rare earth elements in the inner shell portion is lower than that in the periphery of the outer shell portion by 10% or more; when the shortest distance between the periphery of the crystal grain and the inner shell portion is set as L and the equivalent circle diameter of the crystal grain is set as r, the average of L/r ranges from 0.03 to 0.40; at the cross-section of the crystal grain, the number of the crystal grains with the core-shell structure accounts for 20% or more based on the number of total crystal grains forming the sintered body.

PATENT DOCUMENTS

Patent Document 1: JP5-10806
Patent Document 2: JP7-122413
Patent Document 3: WO2006/098204

SUMMARY

However, the heavy rare earth element is always expensive. Recently, the price rises more rapidly than before. In view of the current usage amount, manufacturing products is under threat. Thus, the R-T-B based sintered magnet which could maintain high magnetic properties and reduce the usage amount of heavy rare earth elements is desperately desired.

The present invention has been completed based on such a technical problem. The objective of the present invention is to provide an R-T-B based sintered magnet which maintains conventional high magnetic properties and reduces the usage amount of heavy rare earth elements.

To achieve the above goal, an R-T-B based sintered magnet of the present invention is characterized in comprising main phase grains and grain boundary phases. The main phase grain contains a core portion with a relatively high amount of heavy rare earth elements and a shell portion with a relatively low amount of heavy rare earth elements. In the main phase $LR_{(2-x)}HR_xT_{14}B$ of the core portion (LR: Nd is essential and one or two or more light rare earth elements selected from the group consisting of Y (yttrium), La (lanthanum), Ce (cerium), Pr (praseodymium) and Sm (samarium) are contained; HR: Dy (dysprosium) or/and Tb (terbium) is/are essential and one or two or more heavy rare earth elements selected from the group consisting of Gd (gadolinium), Ho (holmium), Er (erbium), Tm (thulium), Yb (ytterbium) and Lu (lutetium) are contained; T: Fe (iron) or/and Co (cobalt) is/are essential and one or two elements selected from the group consisting of Mn (manganese) and Ni (nickel) are contained; B: boron with part of it substituted by C (carbon)), x ranges from 0.00 to 0.07. In the main phase $LR_{(2-x)}HR_xT_{14}B$ of the shell portion, x ranges from 0.02 to 0.40. And the maximum thickness of the shell portion ranges from 7 nm to 100 nm. Preferably, in the grain boundary phase of the two-grain boundary of the main phase grains, R (R is Y (yttrium) and one or two or more rare earth elements) accounts for 10 to 30 at %, T (T is one or two or more transition metals containing Fe or the combination of Fe and Co as the essential) accounts for 65 to 85 at %, Cu accounts for 0.70 to 4.0 at %, and Al accounts for 0.07 to 2.0 at %.

In addition, it is more preferable that LR is Nd or/and Pr and HR is Dy or/and Tb.

Further, it is more preferable that the volume ratio of the core portion based on the whole main phase grain is 90.0% or more.

Further, it is more preferable that in the composition of the R-T-B based sintered magnet, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

According to the present invention, an R-T-B based sintered magnet which maintains high magnetic properties and reduces the usage amount of heavy rare earth elements is provided.

DETAILED DESCRIPTION OF EMBODIMENTS

Structure

The R-T-B base sintered magnet of the present invention consists of main phase grains and grain boundary phases, wherein the main phase grain has the main phase $LR_{(2-x)}HR_xT_{14}B$ as the main phase (LR: Nd is essentially contained and one or two or more light rare earth elements selected from the group consisting of Y, La, Ce, Pr and Sm are contained; HR: Dy or/and Tb is/are essentially contained and one or two or more heavy rare earth elements selected from the group consisting of Gd, Ho, Er, Tm, Yb and Lu are contained; T: Fe or/and Co is/are essentially contained and one or two elements selected from the group consisting of Mn and Ni are contained; B: boron with part of it substituted by C (carbon)), and the grain boundary phase is mainly composed of R (R is Y (yttrium) and one or two or more rare earth elements) and T (T is one or two or more elements and contains Fe or the combination of Fe and Co as the essential). Further, the main phase grain has the structure composed of a core portion in which x ranges from 0.00 to 0.07 in the main phase $LR_{(2-x)}HR_xT_{14}B$ and a shell portion in which x ranges from 0.02 to 0.40 in the main phase $LR_{(2-x)}HR_xT_{14}B$.

Figure 1:
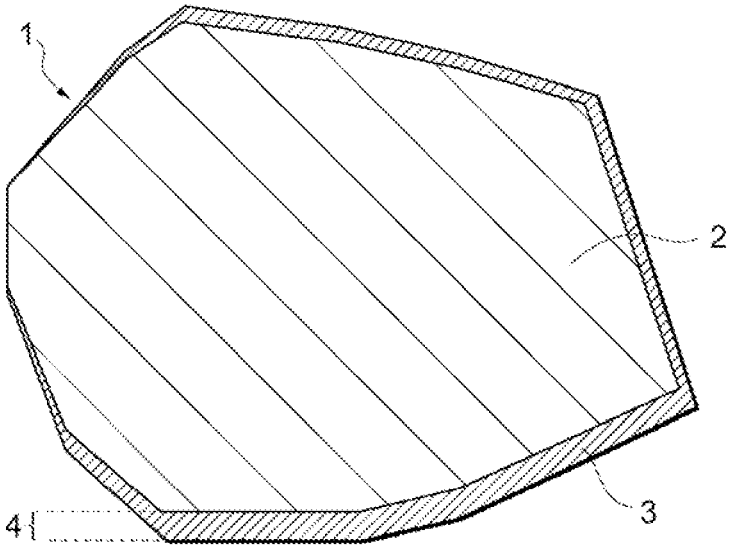
FIG. 1 is a drawing showing the pattern of the main phase grain having a core portion and a shell portion according to the present invention.

FIG. 1 is a pattern figure showing the main phase grain 1 of the present invention which contains a core portion 2 and a shell portion 3. The concentration of HR in the core portion 2 is lower than that in the shell portion 3. For the maximum thickness 4 of the shell portion, the maximum thickness is obtained at the shell portion of the observed main phase grain 1.

The coervicity (HcJ) can be elevated by increasing x of the main phase $LR_{(2-x)}HR_xT_{14}B$ and improving the magnetic anisotropy field of the main phase $LR_{(2-x)}HR_xT_{14}B$ near the interface between the main phase grain, which is a start for generation of reverse magnetic domains, and the grain boundary phase. However, the more HR the main phase contains, the lower saturation magnetization is and the lower residual flux density (Br) showing intensity of magnetism of a magnet is. Thus, Br can be maintained at a high level if the amount of HR is decreased in the core portion of the main phase grains which have little effect on HcJ and the volume ratio of the core portion is increased relative to the whole magnet. Based on such reason, the volume ratio of the core portion in which x ranges from 0.00 to 0.07 in the main phase $LR_{(2-x)}HR_xT_{14}B$ is preferably 90.0% or more in the R-T-B based sintered magnet of the present invention in view of maintaining a high Br and sharply increasing HcJ.

<Composition>

In the R-T-B based sintered magnet of the present invention, x preferably ranges from 0.00 to 0.02 in the main phase $LR_{(2-x)}HR_xT_{14}B$ of the core portion of the main phase grains, and x more preferably ranges from 0.20 to 0.40 in the main phase $LR_{(2-x)}HR_xT_{14}B$ of the shell portion of the main phase grains. In the R-T-B based sintered magnet of the present invention, a high Br can be maintained by decreasing the amount of HR in the core portion of the main phase grains, and HcJ can be sharply improved by elevating the amount of HR in the shell portion. If x ranges from 0.00 to 0.02 in the main phase $LR_{(2-x)}HR_xT_{14}B$ of the core portion of the main phase grains, no HR is contained in the core portion including cases having analytical errors, Br can be sufficiently elevated. If x ranges from 0.20 to 0.40 in the main phase $LR_{(2-x)}HR_xT_{14}B$ of the shell portion of the main phase grains, a relatively high content of HR is contained in the shell portion so that HcJ is greatly increased.

In the R-T-B based sintered magnet of the present invention, in the grain boundary phase of two-grain boundary of the main phase grains, R (R is Y (yttrium) and one or two or more rare earth elements) accounts for 10 to 30 at %, and T (T is one or two or more transition metals containing Fe or the combination of Fe and Co as the essential) accounts for 65 to 85 at %. Thus, in the interface between the grain boundary phase of two-gain boundary and the main phase gain, wettability can be maintained at the grain boundary phase which contains R and T. In addition, the wettability of the grain boundary phase which contains R and T can be further improved and the coercivity can be further elevated by containing 0.70 to 4.0 at % of Cu and 0.07 to 2.0 at % of Al in the grain boundary phase.

The grain boundary phase of the two-grain boundary is present between two adjacent main phase grains in the grain boundary phase, and it is different from the grain boundary triple point in an area with a width of about several nanometers which contains a phase mainly composed of R and T and needle-like or plate-like precipitates according to the composition.

In view of the cost of raw materials as well as the magnetic properties, LR of the main phase $LR_{(2-x)}HR_xT_{14}B$ of the main phase gains in the R-T-B based sintered magnet of the present invention is preferred to be Nd or/and Pr, and HR is preferably Dy or/and Tb.

In the R-T-B based sintered magnet of the present invention, with respect to the B in the main phase $LR_{(2-x)}HR_xT_{14}B$ of the main phase grains, the magnetic anisotropy field of the main phase is elevated if part of B is replaced by C. Also, elevation of the coercivity may be connected with it. However, if the content of C is too high, the reaction of forming carbides between the rare earth elements of the grain boundary phase and carbon become significant so that coercivity will be reduced due to the shortage of the rare earth elements of the grain boundary phase. Furthermore, if the amount of the rare earth elements in the grain boundary phase is decreased, the interaction between these rare earth elements and the coated additive alloy with a high melting point which is used in the present invention is inhibited. Thus, it is hard to form the main phase grains containing the core portion and the shell portion as the objective of the present invention. Based on these viewpoints, B is preferably contained in an amount of 0.75 to 1.25 mass %.

In the R-T-B based sintered magnet of the present invention, Si (silicon), Ga (gallium), Zr (zirconium), Nb (niobium), Ag (silver), Sn (tin), Hf (hafnium), Ta (tantalum), W (tungsten), Au (gold), Bi (bismuth) and the like can be contained as additive elements. In addition, trace amounts of Ca (calcium), Sr (strontium) and Ba (barium), 300 to 1200 ppm of O (oxygen) and 100 to 900 ppm of N (nitrogen) may be contained as the inevitable impurities. Further, C is contained to replace part of B in the main phase $LR_{(2-x)}HR_xT_{14}B$ of the main phase grains. Since carbides are easily formed between the rare earth elements and carbon, C is preferably contained at an amount of 500 to 2300 ppm.

<Preparation Method>

The R-T-B based sintered magnet of the present invention is preferably obtained by a single-alloy method with one kind of raw alloy or a two-alloy method with two kinds of raw alloys. Specifically, separately prepared compound powders which contains HR and has its surface coated with a gradient having a high melting point are added to the finely pulverized raw alloy powders in minute quantity so as to make a molded body. Compared to sintering step of sintering the finely pulverized raw alloy powders, the sintering step of the molded body is performed at a high temperature for a very short time without cooling.

In order to form the main phase $LR_{(2-x)}HR_xT_{14}B$, the raw alloy for the R-T-B based sintered magnet of the present invention consists of the composition containing R (R represents Y (yttrium) and one or two or more rare earth elements), T (T represents one or two or more transition metals and contains Fe or the combination of Fe and Co as the essential) and B (boron with part of it replaced with C (carbon)). In the composition, it is preferable that R ranges from 26.5 to 35.0 mass %, T ranges from 63.75 to 72.65 mass % and B ranges from 0.75 to 1.25 mass %. Further, if the two-alloy method using a second alloy is adopted to prepare the R-T-B based sintered magnet of the present invention, a higher Br can be maintained. Thus, the two-alloy method is preferred. In case of the two-alloy method, in the second alloy, R preferably ranges from 29.0 to 60.0 mass % and T ranges from 40.0 to 71.0 mass %. When the second alloy is to be mixed with the first alloy which contains the main phase, the mixing ratio of the first alloy to the second alloy (the first alloy/the second alloy) is in the range of 0.97/0.03 to 0.70/0.30. In the viewpoint of obtaining high magnetic properties, the ratio is preferably 0.95/0.05 to 0.80/0.20, and more preferably 0.95/0.05 to 0.85/0.25.

The raw alloy can be prepared by an ingot, a strip casting, a centrifugal casting and the like.

According to the composition of the raw alloy, the prepared R-T-B based sintered magnet of the present invention contains 29.4 to 31.5 mass % of LR, 0.15 to 0.65 mass % of HR, 0.03 to 0.40 mass % of Al, 0.03 to 1.10 mass % of Co, 0.03 to 0.18 mass % of Cu, 0.75 to 1.25 mass % of B and a balance of Fe. As the inevitable impurities, O accounts for 0.03 to 0.12 mass %, N accounts for 0.01 to 0.09 mass % and C accounts for 0.05 to 0.23 mass %. Further, Si (silicon), Ga (gallium), Zr (zirconium), Nb (niobium), Ag (silver), Sn (tin), Hf (hafnium), Ta (tantalum), W (tungsten), Au (gold), Bi (bismuth) and the like can be contained as additive elements except Al and Cu.

The raw alloys can be separately pulverized or pulverized together. The pulverization step is generally divided into a coarse pulverization step and a fine pulverization step. Firstly, the raw alloys are coarsely pulverized to a particle size of about several hundreds micrometers in the coarse pulverization step. The coarse pulverization is preferably performed by using a stamp mill, a jaw crusher, a BRAUN mill and the like under an inert gas atmosphere. In order to increase coarse pulverization efficiency, it will be effective that coarse pulverization is performed after hydrogen is adsorbed to the raw alloy and then released.

After the coarse pulverization step, the fine pulverization is performed. The coarsely pulverized powders with a particle size of approximately several hundreds micrometers are finely pulverized to powders with a particle size of 2 to 8 μm. In the fine pulverization step, a jet mill can be used in which an inert gas such as nitrogen, argon or the like is used as the pulverization gas. During the fine pulverization, the addition of about 0.01 to 0.25 mass % of additives such as zinc stearate or oleamide will result in the improvement of orientation upon molding. If the grain size of the main phase grains in the R-T-B based sintered magnet functions as the fine sintered structure, the reverse magnetic field of each main phase gain will be small so that magnetization state will be stabilized and HcJ is elevated. For the preparation of the fine sintered structure, it is the most common to micronize the particle size of the finely pulverized powders and use the powders. However, if nitrogen is used as the pulverization gas in the jet mill, R reacts with nitrogen during finely pulverizing the coarsely pulverized powders so that the R-rich liquid phase components which are essential in sintering step may be not enough. Thus, the particle size after pulverization may be 3 μm or more, and preferably 4 μm or more. If the fine pulverization is performed when the average particle size is 2 to less than 3 μm, argon which does not react with R can be used as the pulverization gas. If the finely pulverized powders with the average particle size below 2 μm are used, a higher HcJ can be forecasted. However, argon is not preferred as the pulverization gas because product yield will be lowered due to the low efficiency of pulverization. Generally speaking, when extremely fine powders with the particle size less than 2 μm are prepared with a high product yield, helium is used as the pulverization gas which is inert to the rare earth elements and has a high pulverization efficiency. However, helium is extremely expensive which causes a high process cost, so it is not suitable for the mass production. On the other hand, if the particle size of the finely pulverized powders is much too large, it is hard for the product to obtain HcJ that is high enough. Thus, the average particle size is preferred to be 8 μm or less. In this respect, the finely pulverized powders can have the average particle size of 2 to 8 μm if considering the balance between the magnetic properties and the process cost in mass production.

The additive compound powders which contain HR and have their surfaces coated with components having a high melting point are added to the finely pulverized powders. Then, the powders can be mixed by using a Nauta mixer, a planetary mixer and the like.

The additive compound powders to be added must contain 25.0 mass % or more of HR. If the content of HR is much less than 25.0 mass %, HcJ will not be sufficiently elevated, or the influence of the component which inhibits densification during sintering the R-T-B based sintered magnet or the influence of the component which deteriorates the magnetic properties especially HcJ will be evident. The simple substances, halides, hydrides or alloys of HR can be used as a compound containing HR.

As for the component with a high melting point which is used as the coating layer, a melting point which makes the compound hard to be melted during the sintering step will be necessary. In addition, a layer which has a low wettability with the R-rich liquid phase components generated in the sintering step is preferable because the start of the reaction of the additive compound can be easily controlled via the sintering temperature. The example of the coating layer is boron carbide, boron nitride, silicon carbide, silicon nitride, aluminium nitride, titanium nitride, zirconium boride, hafnium boride, tungsten carbide or the like. The coating method can be one suitable for the components of the coating layer such as PVD, CVD, vapor deposition method and a method in which the coating layer is formed on the surface of HR compound via a chemical reaction.

In addition, the thickness of the coating layer is not particularly limited. The thickness can be one which renders the coating layer easily to be reacted or melted during sintering, or one that will not make the coating layer left in an unreacted state. With respect to the elements contained in the components of the coating layer, carbon, nitrogen and the like will be easily recognized as impurities in the structure of the R-T-B based sintered magnet which deteriorate the magnetic properties. If too much boron is contained, soft magnetic phases, such as $Fe_2B$, and non-magnetic phases will be formed in the grain boundary to worsen the magnetic properties. Thus, it is preferable that a much too thick coating layer is avoided to be formed. The thickness of the coating layer varies depending on the component in use. However, it will be enough if a layer with a thickness of 100 nm to less than 1 μm can be formed.

Thereafter, the mixed powders of the raw alloy are molded in the magnetic field. During molding in the magnetic field, inert atmosphere such as nitrogen, argon or the like is used. The oxygen concentration should be less than 100 ppm so as to prevent the finely pulverized raw alloy powders from oxidizing. The molding is performed in an oriented magnetic field of 12 to 17 kOe (960 to 1360 kA/m) under a molding pressure of about 0.7 to 2.0 tonf/cm$^2$ (70 to 200 MPa).

Then, the molded body which is molded in the magnetic field is sintered under vacuum or inert atmosphere. From the start to the middle of the sintering process, the sintering is performed at a sintering temperature appropriate for the cases without the additive compound powders, the composition of the raw alloy and the particle size of fine powders. Before cooling from heating at this temperature, a process is incorporated in which the temperature is rapidly increased to a level higher than the sintering temperature appropriate for the case without the additive compound powders and this process is maintained for a short time.

Because of the process under a high temperature, the reaction between the additive compound powders and the R-rich liquid components is promoted and HR replaces the LR in the main phase around the grain boundary of the main phase grains, wherein the additive compound powders are coated with a component having a high melting point which inhibits the reaction under said proper sintering temperature. In view of the balance of the uniform heating when several molded bodies are sintered and the HR release from the additive compound powders, the temperature for the high temperature process is preferably higher than the proper sintering temperature by 40 to 80° C.

The temperature preferably rises in a rate of 8 to 20° C./minute. If the rate is lower than the range, the HR in the additive compound powders may over-disperse into the main phase so that Br will significantly decrease. On the other hand, if the rate is higher than the range, it is hard to get uniform heat, sharply promoting an abnormal grain growth on the surface of the magnet. The deviation of HcJ within a sintered body or sintered bodies located at different places in the sintering furnace cannot be ignored. Thus, the magnetic properties and the production stability may be deteriorated. Further, the duration is preferably 60 minutes or less. If the step is maintained for a longer time, the abnormal grain growth will be promoted and HcJ will evidently decrease. During the sintering process, extremely fine main phase grains with a sub-nanometer size will be incorporated to large main phase grains by dissolution and re-precipitation and thus disappear. However, only a few extremely fine main phase grains are present in the finely pulverized powders processed by a jet mill. Thus, in the sintered body prepared under a proper sintering condition which does not cause the over-growth of grains, the average grain size of the main phase grains is thought to be substantially the same as the average particle size of the used finely pulverized powders.

Then, the obtained sintered bodies are subjected to an aging treatment (thermal treatment) with a temperature lower than the sintering temperature. The aging treatment is performed at 430 to 630° C. under vacuum or an inert gas atmosphere for about 30 minutes to 180 minutes. In addition, the two-stage aging treatment is preferred as HcJ can be further improved in the two-stage aging treatment compared to the one-stage step. If the aging treatment is conducted in two stages, the first stage is performed at a temperature higher than that of the second stage. That is, the first stage proceeds under vacuum or an inert gas atmosphere at 650 to 950° C. for about 30 minutes to 180 minutes. Further, in order to form a lot of main phase grains having more uniform shell portion in the whole magnet, it is preferable that the first stage is performed at 700 to 800° C. for about 60 minutes to 180 minutes or performed at 850 to 950° C. for about 30 minutes to 50 minutes.

The R-T-B based sintered magnet of the present invention can be formed by adding additive compound powders which contain HR and are coated by a component with a high melting point to the finely pulverized powders, and can also be formed by a grain boundary dispersion method in which the powders containing HR is attached to the surface of the sintered body or the layer containing HR is subjected to the film formation and then the thermal treatment.

EXAMPLES

Hereinafter, the present invention will be further described based on the detailed Examples. However, the present invention is not limited to these Examples.

Example 1

The raw alloys with composition A and composition D listed in Table 1 were prepared by the strip casting method.

The prepared raw alloy A and raw alloy D were mixed with a ratio of 0.95/0.05. After hydrogen adsorbing at room temperature for 90 minutes, a dehydrogenation treatment was performed under an argon gas atmosphere at 650° C. for 60 minutes to conduct coarse pulverization.

To the coarsely pulverized raw alloy powders, 0.10 mass % of oleamide was added as a pulverization assistant. Then, fine pulverization proceeded by a jet mill using highly pressurized nitrogen gas, and finely pulverized powders with the average particle size of 4.0 μm were obtained.

TABLE 1

| | Nd (mass %) | Pr (mass %) | Dy (mass %) | Tb (mass %) | Co (mass %) | Cu (mass %) | Al (mass %) | B (mass %) | Fe (mass %) |
|---|---|---|---|---|---|---|---|---|---|
| A | 31.00 | — | — | — | — | — | — | 1.05 | 67.95 |
| B | 30.79 | — | 0.21 | — | — | — | — | 1.05 | 67.95 |
| C | 28.90 | — | 0.68 | — | — | — | — | 1.05 | 69.37 |
| D | 40.00 | — | — | — | — | — | — | — | 60.00 |
| E | 40.00 | — | — | — | 0.50 | 0.50 | — | — | 59.00 |
| F | 40.00 | — | — | — | 20.00 | 3.00 | 8.00 | — | 29.00 |
| G | — | — | 80.00 | — | 10.00 | 10.00 | — | — | — |
| H | — | 31.00 | — | — | — | — | — | 1.05 | 67.95 |
| I | 25.00 | 6.00 | — | — | — | — | — | 1.05 | 67.95 |
| J | 31.00 | — | — | — | — | — | — | 0.78 | 68.22 |
| K | — | 40.00 | — | — | — | — | — | — | 60.00 |
| L | — | — | — | 80.00 | 10.00 | 10.00 | — | — | — |
| M | — | — | 40.00 | 40.00 | 10.00 | 10.00 | — | — | — |
| N | — | — | 70.00 | — | 10.00 | 10.00 | 10.00 | — | — |

The ingots corresponding to the composition G were melted at a high frequency. The melted liquid was quenched via the roller, and the alloy compound containing Dy in accordance with the composition G listed in Table 1 was prepared as a strip. The prepared strip was pulverized in a dry media to powders with the average particle size being less than 10 μm. The plate of the cubic boron nitride (c-BN) was used as the target and a c-BN coating layer was formed on the surface of the powders by slowly stirring the coated powders with shaking upon sputtering.

The coated compound powders were added in to the finely pulverized raw alloy powders in an amount of 0.25 mass %. The resultant mixture was mixed using a small Nauta mixer.

Then, the finely pulverized powders mixed with the compound powders were molded in nitrogen gas atmosphere in a magnetic field of 15 kOe (1200 kA/m) under a pressure of 1.5 tonf/cm$^2$ (150 MPa) so as to obtain a molded body.

The obtained molded body was sintered at 1010° C. for 100 minutes under a reduced pressure of $10^{-2}$ Pa or less without a cooling step. Then, the temperature increased to 1070° C. with a rate of 10° C./min and was maintained for 20 minutes. Then, the molded body was rapidly cooled down by providing argon gas with a pressure.

Next, the sintered body was subjected to a thermal treatment at 780° C. for 90 minutes in an argon gas atmosphere under air pressure (the first stage of aging treatment). After cooled down, a thermal treatment was performed at 540° C. for 90 minutes in an argon gas atmosphere under air pressure (the second stage of aging treatment) so as to prepare a test sample.

The obtained test sample was measured for the magnetic properties by using a BH tracer. The structure was evaluated by STEM-EDS and atom probe analysis. Further, the composition of the sintered body was analyzed and determined by X-ray fluorescence spectrometry.

Example 2

The raw alloys with composition A and composition D listed in Table 1 were respectively prepared as finely pulverized powders as in Example 1. The alloy compound containing Dy according to the composition G listed in Table 1 was prepared as in Example 1 and was added into the finely pulverized raw alloy powders in an amount of 0.80 mass %. Then, a test sample was prepared as in Example 1.

Example 3

A test sample was prepared as in Example 1 except that the raw alloys with composition B and composition D listed in Table 1 were used.

Example 4

The raw alloys with composition B and composition D listed in Table 1 were respectively prepared as finely pulverized powders as in Example 1. The alloy compound with composition G listed in Table 1 was prepared as in Example 1 and was added into the finely pulverized raw alloy powders in an amount of 0.40 mass %. Then, a test sample was prepared as in Example 1.

Example 5

The raw alloys with composition A and composition D listed in Table 1 were prepared as coarsely pulverized powders as in Example 1, and 0.10 mass % of oleamide was added as the pulverization assistant. Then, a fine pulverization step proceeded by a jet mill using highly pressurized argon gas, and finely pulverized powders with the average particle size of 2.0 μm were obtained.

The alloy compound containing Dy according to the composition G listed in Table 1 was prepared as in Example 1 and was added into the finely pulverized raw alloy powders in an amount of 0.25 mass %. The resultant mixture was mixed by using a small Nauta mixer and then molded under nitrogen gas atmosphere in a magnetic field of 15 kOe (1200 kA/m) under a pressure of 1.5 tonf/cm$^2$ (150 MPa) so as to obtain a molded body.

The obtained molded body was fired at 940° C. for 100 minutes under a reduced pressure of $10^{-2}$ Pa or less without a cooling step. Then, the temperature increased to 980° C. with a rate of 8° C./min and was maintained for 20 minutes. Then, the molded body was rapidly cooled down by providing argon gas with a pressure.

Thereafter, the sintered body was subjected to a thermal treatment at 780° C. for 90 minutes in argon gas atmosphere under air pressure (the first stage of aging treatment). After cooled down, a thermal treatment was provided at 540° C.

for 90 minutes in argon gas atmosphere under air pressure (the second stage of aging treatment) so as to prepare a test sample.

Example 6

The raw alloys with composition A and composition D listed in Table 1 were prepared as coarsely pulverized powders as in Example 1, and 0.10 mass % of oleamide was added as the pulverization assistant. Then, a fine pulverization step proceeded by a jet mill using highly pressurized argon gas, and finely pulverized powders with the average particle size of 3.0 μm were obtained. Then, the alloy compound containing Dy according to the composition G listed in Table 1 was prepared as in Example 1 and was added into the finely pulverized raw alloy powders in an amount of 0.25 mass %. The resultant mixture was mixed by using a small Nauta mixer and then molded under nitrogen gas atmosphere in a magnetic field of 15 kOe (1200 kA/m) under a pressure of 1.5 tonf/cm$^2$ (150 MPa) so as to obtain a molded body.

The obtained molded body was fired at 1000° C. for 100 minutes under a reduced pressure of $10^{-2}$ Pa or less without a cooling step. Then, the temperature increased to 1040° C. with a rate of 10° C./min and was maintained for 20 minutes. Then, the molded body was rapidly cooled down by providing argon gas with a pressure.

Thereafter, the sintered body was subjected to a thermal treatment at 780° C. for 90 minutes in argon gas atmosphere under air pressure (the first stage of aging treatment). After cooled down, a thermal treatment was provided at 540° C. for 90 minutes in argon gas atmosphere under air pressure (the second stage of aging treatment) so as to prepare a test sample.

Example 7

A test sample was prepared as in Example 1 except the raw alloys with composition J and composition D listed in Table 1 were used.

Example 8

A test sample was prepared as in Example 1 except the raw alloys with composition H and composition D listed in Table 1 were used.

Example 9

A test sample was prepared as in Example 1 except the raw alloys with composition I and composition D listed in Table 1 were used.

Example 10

The raw alloys with composition A and composition D listed in Table 1 were respectively prepared as finely pulverized powders as in Example 1. The alloy compound with composition L listed in Table 1 was prepared as in Example 1 and was added into the finely pulverized raw alloy powders in an amount of 0.25 mass %. Then, a test sample was prepared as in Example 1.

Example 11

The raw alloys with composition A and composition D listed in Table 1 were respectively prepared as finely pulverized powders as in Example 1. The alloy compound with composition M listed in Table 1 was prepared as in Example 1 and was added into the finely pulverized raw alloy powders in an amount of 0.25 mass %. Then, a test sample was prepared as in Example 1.

Example 12

The raw alloys with composition A and composition D listed in Table 1 were respectively prepared as finely pulverized powders as in Example 1. The alloy compound with composition N listed in Table 1 was prepared as in Example 1 and was added into the finely pulverized raw alloy powders in an amount of 0.30 mass %. Then, a test sample was prepared as in Example 1.

Example 13

The raw alloys with composition A and composition F listed in Table 1 were respectively prepared as finely pulverized powders as in Example 1. The alloy compound with composition G listed in Table 1 was prepared as in Example 1 and was added into the finely pulverized raw alloy powders in an amount of 0.25 mass %. Then, a test sample was prepared as in Example 1.

Comparative Example 1

The raw alloys with composition B and composition D listed in Table 1 were respectively prepared as finely pulverized powders as in Example 1. Without the addition of the alloy compound containing Dy according to composition G listed in Table 1, a test sample was prepared as in Example 1.

Comparative Example 2

The raw alloys with composition A and composition D listed in Table 1 were respectively prepared as finely pulverized powders as in Example 1. The alloy compound containing Dy according to the composition G listed in Table 1 was pulverized as in Example 1 but was not coated by the c-BN coating layer, and the pulverized powders were added to the finely pulverized raw alloy powders in an amount of 0.25 mass %. The resultant mixture was mixed by a small Nauta mixer and then prepared as a test sample as in Example 1.

Comparative Example 3

The raw alloys with composition B and composition E listed in Table 1 were respectively prepared as finely pulverized powders as in Example 1. Without the addition of the alloy compound containing Dy according to composition G listed in Table 1, a test sample was prepared as in Example 1.

Comparative Example 4

The raw alloys with composition C and composition E listed in Table 1 were respectively prepared as finely pulverized powders as in Example 1. Without the addition of the alloy compound containing Dy according to composition G listed in Table 1, a test sample was prepared as in Example 1.

Comparative Example 5

The raw alloys with composition A and composition D listed in Table 1 were respectively prepared as finely pulverized powders as in Example 5. The alloy compound containing Dy according to the composition G listed in Table 1 was pulverized as in Example 5 but was not coated by the c-BN coating layer, and the pulverized powders were added to the finely pulverized raw alloy powders in an amount of 0.25 mass %. The resultant mixture was mixed by a small Nauta mixer and then prepared as a test sample as in Example 5.

Comparative Example 6

The raw alloys with composition A and composition D listed in Table 1 were respectively prepared as finely pulverized powders as in Example 6. The alloy compound containing Dy according to the composition G listed in Table 1 was pulverized as in Example 6 but was not coated by the c-BN coating layer, and the pulverized powders were added to the finely pulverized raw alloy powders in an amount of 0.25 mass %. The resultant mixture was mixed by a small Nauta mixer and then prepared as a test sample as in Example 6.

Table 2 showed the content of HR in the samples, the magnetic properties evaluated by a BH tracer, the minimum value and maximum value of x estimated by the results of STEM-EDS and atom probe analysis, the maximum value of the shell width, the average grain size of the sintered body, the volume ratio of the core portion and the content B in Examples 1 to 13, Comparative Examples 1 to 6 and Reference Examples 1 to 7. In addition, the sample composition analysis determined by X-ray fluorescence spectrometry was summarized in Table 3.

Figure 2:
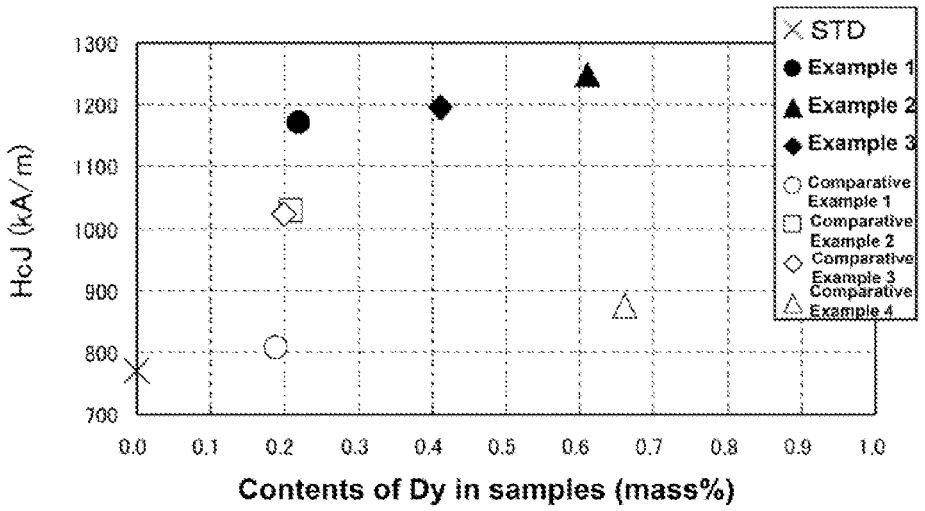
FIG. 2 is a graph showing the obtained HcJ values relative to the contents of Dy in Example 1, Example 2, Example 3, Comparative Example 1, Comparative Example 2, Comparative Example 3 and Comparative Example 4.
Figure 3:
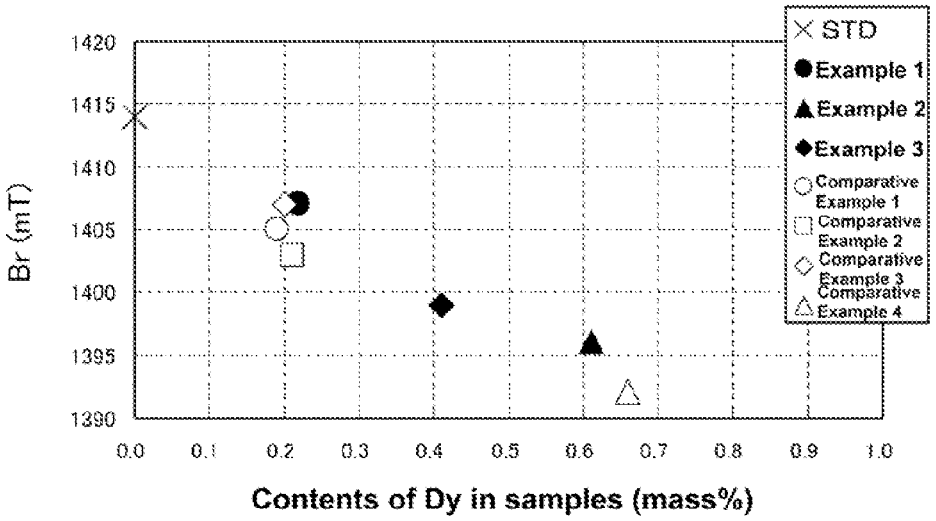
FIG. 3 is a graph showing the obtained Br values relative to the contents of Dy in Example 1, Example 2, Example 3, Comparative Example 1, Comparative Example 2, Comparative Example 3 and Comparative Example 4.

Further, FIG. 2 showed the HcJ changes relative to the contents of Dy in Example 1 to 3 and Comparative Examples 1 to 4. FIG. 3 showed the Br changes relative to the contents of Dy in Example 1 to 3 and Comparative Examples 1 to 4.

TABLE 2

| | Content of HR | | | | | x in core portion | | x in shell portion | | Maximum thickness | Average | Volume ratio | Content |
|---|---|---|---|---|---|---|---|---|---|---|---|---|---|
| | Dy (mass %) | Tb (mass %) | Br (mT) | HcJ (kA/m) | ΔHcJ (kA/m) | MIN | MAX | MIN | MAX | of the shell (nm) | grain size (μm) | of core portion (%) | of B (mass %) |
| Example 1 | 0.22 | — | 1407 | 1172 | 401 | 0.00 | 0.01 | 0.02 | 0.08 | 7 | 3.88 | 99.9 | 1.02 |
| Example 2 | 0.61 | — | 1396 | 1250 | 479 | 0.00 | 0.03 | 0.09 | 0.40 | 100 | 4.15 | 98.9 | 1.01 |
| Example 3 | 0.41 | — | 1399 | 1195 | 424 | 0.05 | 0.07 | 0.13 | 0.18 | 75 | 4.08 | 99.1 | 1.02 |
| Example 4 | 0.50 | — | 1396 | 1219 | 448 | 0.03 | 0.06 | 0.14 | 0.24 | 93 | 4.11 | 98.9 | 1.00 |
| Example 5 | 0.59 | — | 1331 | 1456 | 443 | 0.00 | 0.04 | 0.07 | 0.33 | 98 | 1.94 | 89.3 | 1.06 |
| Example 6 | 0.58 | | 1383 | 1378 | 503 | 0.00 | 0.01 | 0.10 | 0.38 | 99 | 2.63 | 95.7 | 1.06 |
| Example 7 | 0.22 | — | 1418 | 892 | 479 | 0.00 | 0.01 | 0.03 | 0.07 | 34 | 3.91 | 99.5 | 0.72 |
| Example 8 | 0.24 | — | 1347 | 1321 | 309 | 0.00 | 0.04 | 0.05 | 0.08 | 21 | 4.24 | 99.8 | 1.02 |
| Example 9 | 0.24 | — | 1402 | 1202 | 393 | 0.00 | 0.01 | 0.04 | 0.10 | 13 | 4.02 | 99.8 | 1.03 |
| Example 10 | — | 0.24 | 1405 | 1348 | 577 | 0.00 | 0.01 | 0.02 | 0.10 | 10 | 3.97 | 99.9 | 1.00 |
| Example 11 | 0.10 | 0.12 | 1404 | 1283 | 512 | 0.00 | 0.03 | 0.03 | 0.08 | 9 | 4.19 | 99.9 | 1.01 |
| Example 12 | 0.22 | — | 1403 | 1212 | 441 | 0.00 | 0.01 | 0.02 | 0.08 | 12 | 3.95 | 99.8 | 1.03 |
| Example 13 | 0.24 | — | 1384 | 1386 | 365 | 0.00 | 0.00 | 0.03 | 0.10 | 18 | 4.12 | 99.8 | 1.01 |
| Comparative Example 1 | 0.19 | — | 1405 | 806 | 35 | 0.01 | 0.02 | 0.01 | 0.02 | Cannot be determined | 4.24 | Cannot be determined | 1.00 |
| Comparative Example 2 | 0.21 | — | 1403 | 1028 | 257 | 0.01 | 0.03 | 0.03 | 0.05 | 1280 | 3.98 | 83.8 | 0.97 |
| Comparative Example 3 | 0.20 | — | 1407 | 1023 | 252 | 0.00 | 0.02 | 0.01 | 0.02 | Cannot be determined | 4.16 | Cannot be determined | 0.98 |
| Comparative Example 4 | 0.66 | — | 1392 | 1132 | 361 | 0.04 | 0.07 | 0.06 | 0.11 | 2120 | 4.04 | 74.3 | 0.98 |
| Comparative Example 5 | 0.62 | — | 1320 | 1389 | 376 | 0.00 | 0.04 | 0.05 | 0.40 | 1021 | 2.26 | 29.2 | 0.99 |
| Comparative Example 6 | 0.56 | — | 1366 | 1209 | 334 | 0.00 | 0.01 | 0.07 | 0.39 | 1053 | 3.04 | 70.0 | 0.97 |
| Reference Example 1 | 0.00 | — | 1414 | 771 | — | — | — | — | — | — | 4.19 | — | 1.00 |
| Reference Example 2 | 0.00 | — | 1345 | 1013 | — | — | — | — | — | — | 2.11 | — | 0.98 |
| Reference Example 3 | 0.00 | — | 1389 | 875 | — | — | — | — | — | — | 2.89 | — | 0.99 |
| Reference Example 4 | 0.00 | — | 1427 | 413 | — | — | — | — | — | — | 4.32 | — | 0.70 |
| Reference Example 5 | 0.00 | — | 1353 | 1012 | — | — | — | — | — | — | 4.29 | — | 0.98 |
| Reference Example 6 | 0.00 | — | 1410 | 809 | — | — | — | — | — | — | 4.06 | — | 0.97 |
| Reference Example 7 | 0.00 | — | 1393 | 1021 | — | — | — | — | — | — | 4.14 | — | 1.04 |

TABLE 3

| | Nd (mass %) | Pr (mass %) | Dy (mass %) | Tb (mass %) | Co (mass %) | Cu (mass %) | Al (mass %) | B (mass %) | Fe (mass %) |
|---|---|---|---|---|---|---|---|---|---|
| Example 1 | 31.20 | 0.00 | 0.22 | 0.00 | 0.03 | 0.04 | 0.00 | 1.02 | 66.88 |
| Example 2 | 30.98 | 0.00 | 0.61 | 0.00 | 0.10 | 0.11 | 0.00 | 1.01 | 66.34 |
| Example 3 | 30.88 | 0.00 | 0.41 | 0.00 | 0.04 | 0.04 | 0.00 | 1.02 | 66.98 |
| Example 4 | 31.02 | 0.00 | 0.50 | 0.00 | 0.05 | 0.08 | 0.00 | 1.00 | 66.81 |
| Example 5 | 30.51 | 0.00 | 0.59 | 0.00 | 0.04 | 0.05 | 0.00 | 1.06 | 66.27 |
| Example 6 | 30.19 | 0.00 | 0.58 | 0.00 | 0.04 | 0.04 | 0.00 | 1.06 | 66.13 |
| Example 7 | 31.29 | 0.00 | 0.22 | 0.00 | 0.03 | 0.03 | 0.00 | 0.72 | 67.03 |
| Example 8 | 0.00 | 30.95 | 0.24 | 0.00 | 0.04 | 0.04 | 0.00 | 1.02 | 66.69 |
| Example 9 | 25.24 | 5.77 | 0.24 | 0.00 | 0.04 | 0.04 | 0.00 | 1.03 | 66.60 |
| Example 10 | 31.10 | 0.00 | 0.00 | 0.24 | 0.04 | 0.04 | 0.00 | 1.00 | 66.53 |
| Example 11 | 30.76 | 0.00 | 0.10 | 0.12 | 0.05 | 0.04 | 0.00 | 1.01 | 67.18 |
| Example 12 | 30.95 | 0.00 | 0.22 | 0.00 | 0.04 | 0.05 | 0.03 | 1.03 | 66.59 |
| Reference Example 13 | 30.65 | 0.00 | 0.24 | 0.00 | 1.09 | 0.18 | 0.42 | 1.01 | 65.40 |
| Comparative Example 1 | 31.04 | 0.00 | 0.19 | 0.00 | 0.00 | 0.00 | 0.00 | 1.00 | 66.66 |
| Comparative Example 2 | 31.11 | 0.00 | 0.21 | 0.00 | 0.04 | 0.04 | 0.00 | 0.97 | 66.26 |
| Comparative Example 3 | 30.94 | 0.00 | 0.20 | 0.00 | 0.03 | 0.04 | 0.00 | 0.98 | 66.53 |
| Comparative Example 4 | 29.41 | 0.00 | 0.66 | 0.00 | 0.03 | 0.03 | 0.00 | 0.98 | 67.25 |
| Comparative Example 5 | 31.20 | 0.00 | 0.62 | 0.00 | 0.04 | 0.05 | 0.00 | 0.99 | 66.75 |
| Comparative Example 6 | 31.22 | 0.00 | 0.56 | 0.00 | 0.04 | 0.05 | 0.00 | 0.97 | 66.46 |
| Reference Example 1 | 31.12 | 0.00 | 0.00 | 0.00 | 0.00 | 0.00 | 0.00 | 1.00 | 66.72 |
| Reference Example 2 | 31.20 | 0.00 | 0.00 | 0.00 | 0.00 | 0.00 | 0.00 | 0.98 | 66.67 |
| Reference Example 3 | 31.36 | 0.00 | 0.00 | 0.00 | 0.00 | 0.00 | 0.00 | 0.99 | 66.71 |
| Reference Example 4 | 31.35 | 0.00 | 0.00 | 0.00 | 0.00 | 0.00 | 0.00 | 0.70 | 67.00 |
| Reference Example 5 | 0.00 | 31.07 | 0.00 | 0.00 | 0.00 | 0.00 | 0.00 | 0.98 | 66.46 |
| Reference Example 6 | 25.70 | 5.65 | 0.00 | 0.00 | 0.00 | 0.00 | 0.00 | 0.97 | 66.36 |
| Reference Example 7 | 31.32 | 0.00 | 0.00 | 0.00 | 0.88 | 0.16 | 0.37 | 1.04 | 65.29 |

According to FIG. 2, it could be confirmed that HcJ in Examples 1 and 2 sharply increased compared to that in Comparative Examples 1 and 4 in which the test sample contained almost the same amount of Dy respectively. In other words, according to the present invention, the same HcJ could be obtained with much decrease of the content of Dy. FIGS. 2 and 3 showed HcJ and Br in Reference Example 1 in which the test sample was prepared by adding no additive compound to the finely pulverized raw alloy powders of Example 1. According to FIG. 2, compared to HcJ in Reference Example 1, the content of Dy was increased to be 0.22 mass % in Example 1 and 0.61 mass % in Example 2 while HcJ was elevated by 401 kA/m in Example 1 and 479 kA/m in Example 2. On the other hand, in Comparative Example 1 and Comparative Example 4 in which each test sample contained almost the same amount of Dy from the raw alloys as that in Example 1 and Example 2, the content of Dy was increased to be 0.19 mass % in Comparative Example 1 and 0.66 mass % in Comparative Example 4 while HcJ was only elevated by 35 kA/m in Comparative Example 1 and 105 kA/m in Comparative Example 4. In Example 1 and Example 2 of the present invention, the increase of HcJ was significant due to Dy contained.

Further, in Comparative Example 2, the c-BN coating was not formed on the additive compound powders with composition G in Table 1. If the same amount as that in Example 1 was added to the finely pulverized raw alloy powders, HcJ higher than that in Comparative Example 1 could be obtained. However, as HcJ is lower than that in Example 1 by 144 kA/m and no c-BN coating layer was formed on the surface of the additive compound powders, the additive compound was likely to react with the R-rich liquid phase during the sintering process. Thus, Dy substitution occurred even in a relatively deep place of the core portion of the main phase grains so that the effect of the present invention cannot be sufficiently achieved.

FIG. 3 showed that Br was almost the same in Example 1 compared to Comparative Example 1 in which the content of Dy was almost the same. Also, Br was almost the same in Example 2 compared to Comparative Example 4 in which the content of Dy was almost the same. According to the present invention, Br was maintained while HcJ was sharply increased.

FIGS. 2 and 3 showed that, compared to Comparative Example 3 in which the contents of Dy, Co and Cu were almost the same as that in Example 1, HcJ in Example 1 was larger by 149 kA/m and Br was almost the same as that in Comparative Example 3. The additive elements such as Co, Cu or the like could increase HcJ. And the increase of HcJ in the present invention was quite significant without the increase caused by Co and Cu.

Figure 4:
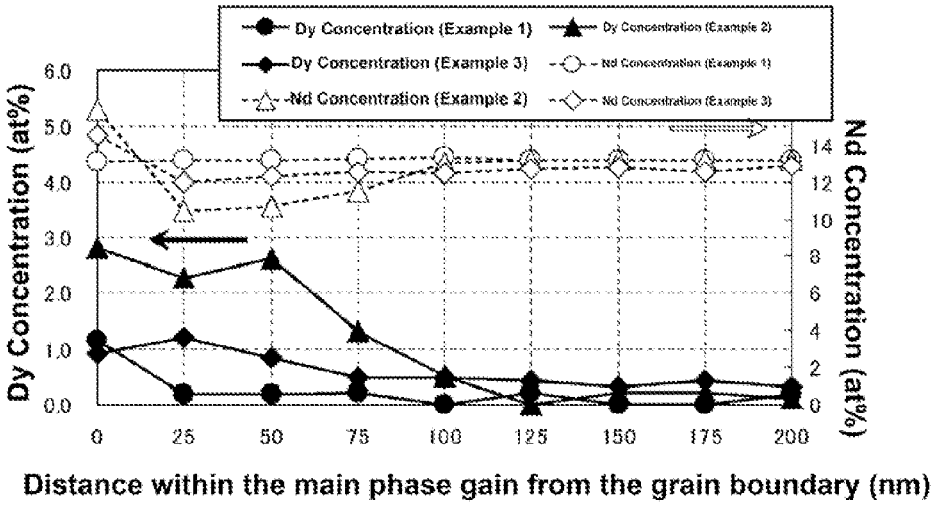
FIG. 4 is a graph showing the concentration changes of Dy and Nd in the direction within the main phase gain from the two-grain boundary by means of STEM-EDS in Example 1, Example 2 and Example 3.

FIG. 4 showed the concentrations of Dy and Nd obtained via STEM-EDS in the direction within the main phase gain from the two-grain boundary in Example 1, Example 2 and Example 3. The region involved in Dy substitution was the biggest from the interface of the grain boundary to the inside of the main phase grain. The distance was confirmed to be 100 nm in Example 2. Also, in this region, the concentration of Dy was the highest and the addition amount of additive compounds was the greatest so that the region of Dy substitution and the concentration of Dy became larger.

The region involved in Dy substitution was about 75 nm in Example 3 but the concentration of Dy was lower than that in Example 2. It was indicated that the presence of Dy in the main phase grain in advance would inhibit the Dy substitution in the main phase.

The concentration distribution of Dy and Nd obtained via STEM-EDS in the direction within the main phase gain from the two-grain boundary in Comparative Examples 1 to 4 was studied. However, in Comparative Examples 1 and 3, the regions involved in Dy substitution could be clearly separated but a clear concentration difference of Dy could not be found. In Comparative Example 2, the region involved in Dy substitution with a Dy concentration difference could be determined although it was quite small. However, the maximum width was 1280 nm which was much wider than that in Examples. Similarly, the region involved in Dy substitution could be determined in Comparative Example 4 but the maximum width was 2120 nm which was wider than that in Examples as well as Comparative Example 2.

In FIG. 4, the region involved in Dy substitution was taken as the maximum width of the shell portion in Examples 2 and 3. With respect to the estimated minimum value to maximum value of x in the maximum width of the shell portion, it was 0.09 to 0.40 in Example 2 and was 0.13 to 0.18 in Example 3.

Further, the region with almost constant Nd concentration distribution compared to the shell portion was taken as the core portion. With respect to the estimated minimum value to maximum value of x in the core portion, it was 0.00 to 0.03 in Example 2 and was 0.05 to 0.07 in Example 3.

Similar to Examples 2 and 3, the minimum value to maximum value of x in both the shell portion and the core portion were estimated for Comparative Examples 1 to 4. In addition, the shell portion could not be clearly determined in Comparative Example 1 and Comparative Example 3, so the minimum value to maximum value of x in both the shell portion and the core portion was estimated with presumption that the shell portion was 1000 nm in width.

With respect to the minimum value to maximum value of x in the shell portion, they were respectively 0.01 to 0.02, 0.03 to 0.05, 0.01 to 0.02, and 0.06 to 0.01 in Comparative Examples 1 to 4. In addition, with respect to the minimum value to maximum value of x in the core portion, they were respectively 0.01 to 0.02, 0.01 to 0.03, 0.00 to 0.02, and 0.04 to 0.07 in Comparative Examples 1 to 4.

In Example 1, the concentration of Dy was high in the grain boundary, but the region involved in Dy substitution within the main phase grain was not clear in STEM-EDS. Thus, the atom probe analysis with higher resolution was conducted. Also, if the region involved in Dy substitution within the main phase grain was not clear in STEM-EDS in other Examples, the atom probe analysis was performed.

Figure 5:
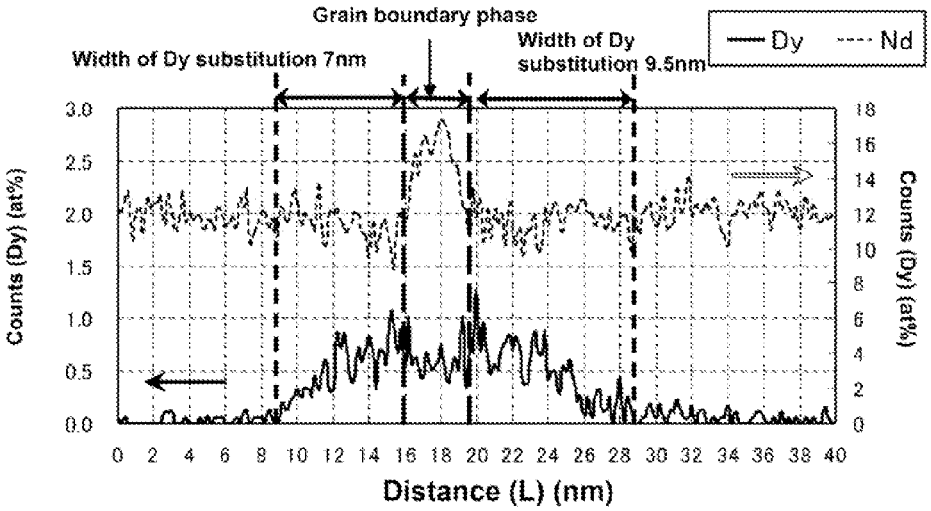
FIG. 5 is a graph showing the concentration changes of Dy and Nd around the two-grain boundary by means of the atom probe analysis in Example 1.

FIG. 5 showed the quantitative values of Dy and Nd around the two-grain boundary in Example 1 derived from the atom probe analysis. However, the concentration of Dy in the interface between the main phase grain and the grain boundary phase was the highest, and the concentration of Nd was lower as the concentration of Dy became higher. Thus, the region involved in Dy substitution within the main phase grain was at least 7 nm.

HcJ was elevated via Dy substitution because nucleation of reverse magnetic domains was inhibited by the high magnetic anisotropy field of Dy. Even in the region involved in Dy substitution of 7 nm in Example 1, a high HcJ would be obtained due to its great effect.

In Example 1, the region involved in Dy substitution which was confirmed by the atom probe analysis was taken as the maximum width of the shell portion. With respect to the minimum value to the maximum value of x in the maximum width of the shell portion, it was 0.02 to 0.08 in Example 2. Further, the region with almost constant Nd concentration distribution compared to the shell portion was taken as the core portion. With respect to the estimated minimum value to maximum value of x in the core portion, it was 0.00 to 0.01 in Example 1.

In Examples 5 and 6, the particle size of the finely pulverized powders was respectively about 2 μm and 3 μm which were smaller than that in Example 4. And the alloy containing the same amount of Dy as that in Example 4 was added to these finely pulverized powders. The grain size of the main phase grain in the fine sintered structure was almost the same in Example 5 and Example 6, and the maximum thickness of the shell portion of the main phase grain was almost the same in these two Examples. Thus, in the powders of Example 5 having a smaller particle size, the volume ratio of the core portion in the main phase grain was smaller. Also, with respect to the magnetic properties, Br was lowered but HcJ was significantly increased which showed the effect of the present invention.

On the other hand, in Comparative Examples 5 and 6, as the c-BN coating layer was not formed in the finely pulverized raw alloy powders which contained Dy as in Examples 5 and 6, a large quantity of Dy was incorporated to the main phase grain to form thick shell portions during the firing step. Compared to the test samples prepared by using only the raw alloys, Br was evidently lowered and HcJ was not significantly elevated as in Examples 5 and 6.

However, in Example 5, the magnetic properties were not a big problem but Br was even more decreased compared to the test samples prepared by using only the raw alloys. As Br was maintained high enough while HcJ was elevated, the volume ratio of the core portion of the main phase grain was 90% or more.

In Example 7, the content of B was only 0.72 and HcJ was only 892 kA/m. This is because HcJ was only 413 kA/m when only raw alloy was used in the preparation. The addition of alloy containing Dy led to a increase of 479 kA/m, which achieved the effect of the present invention.

However, the test sample prepared by using only the raw alloy had proper HcJ for a product, so the original HcJ was also needed in some respect. As in Example 7, the content of B was much too less, so a soft magnetic phase containing Fe was formed so that HcJ was lowered. Thus, the content of B was preferably 0.75 mass % or more.

In Example 8, all Nd in the raw alloy of Example 1 was used to prepare the test sample. In Example 9, the raw alloy having part of Nd replaced with Pr was used to prepare the test sample. However, the effect of the present invention could be obtained as in Example 1 which used only Nd.

In Example 10, all Dy in the alloy containing Dy used in Example 1 was used to prepare the test sample. In Example 11, an alloy having half of Dy replaced with Tb was used to prepare the test sample. HcJ also could be enhanced by the addition of an alloy containing only Dy. This is because the magnetic anisotropy field that greatly affect HcJ in the case that Tb is used to replace LR composing the main phase such as Nd and the like became larger than that in the case of replacing by Dy.

Table 4 showed the contents of R (Nd+Dy), T (Fe+Co), Cu and Al in the two-grain boundary in Example 1, Example 7 and Example 12. In Example 12, the alloy obtained by replacing part of Dy in the alloy containing Dy used in Example 1 with Al was used to prepare the test sample. HcJ was substantially increased compared that in Example 1. According to the atom probe analysis, in the grain boundary phase of the two-grain boundary in Example 12, R including Nd and Dy accounted for 20.36 at % and T including Fe and Co accounted for 73.51 at %. Further, Cu and Al respectively accounted for 0.93 at % and 0.12 at %. In another respect, in Example 1 in which the alloy contained Dy but not Al, the rare earth elements including Nd and Dy accounted for 17.87 at %, T including Fe and Co accounted for 77.15 at %, and Cu and Al respectively accounted for 0.71 at % and 0.05 at %. Thus, the increase of HcJ in Example 12 was more than that in Example 1. This might be due to the addition of Al which had effect on increasing HcJ into the two-grain boundaries.

Furthermore, in Example 7, based on the atom probe analysis of the two-grain boundaries, R including Nd and Dy accounted for 7.39 at %, T including Fe and Co accounted for 91.01 at %, and Cu and Al respectively accounted for 0.80 at % and 0.02 at %. As the content of R was lowered, more T was contained. Thus, as the content of B was decreased to a excess extent in Example 7, the remaining Fe or Co which was not incorporated into the main phase formed the soft magnetic phase with R in the grain boundary phase. This might be the reason why HcJ was quite small. However, Example 7 also showed the effect for elevating HcJ.

As HcJ proper for a product was obtained, in the two-grain boundaries, R (R represents Y (yttrium) and one or two or more rare earth elements) accounted for 10 to 30 at %, T (T represents one or two or more transition metals and contains Fe or the combination of Fe and Co as the necessity) accounted for 65 to 85 at %, and Cu and Al respectively accounted for 0.70 to 4.0 at % and 0.07 to 2.0 at %.

TABLE 4

| | R(Nd + Dy) (at %) | T(Fe + Co) (at %) | Cu (at %) | Al (at %) |
|---|---|---|---|---|
| Example 1 | 17.87 | 77.15 | 0.71 | 0.05 |
| Example 7 | 7.39 | 91.01 | 0.80 | 0.02 |
| Example 12 | 20.36 | 73.51 | 0.93 | 0.12 |

The HcJ was higher in Reference Example 7 than that in Reference Example 1 in which more amounts of Co, Cu and Al from the raw alloys were added than Comparative Examples 3 and 4, no components other than Co, Cu and Al were contained and the composition and structure were substantially the same. However, in Example 13 in which the alloy with composition G listed in Table 1 was added to the components of Reference Example 7, the decrease of Br can be inhibited and HcJ can be elevated just as in other Examples. However, HcJ in Reference Example 1 could not be increased to the level of Example 1 in which the alloy with composition G listed in Table 1 was added. The reason why the increase extent for HcJ in Example 13 was relatively small was not known yet. However, Co and Al could be subjected to the solid solution treatment and went into the main phase to replace Fe of T, which affected the ease of replacement of the added HR with the main phase LR. In addition, Cu was hardly melted to the main phase. However, if a lot of Cu were present there, it reacted with LR of the main phase which was mainly Nd to destroy the main phase. It was predicted that excess Cu was present in the grain boundary as it was concentrated there, which destroyed the main phase grains which had small particle size. Thus, main phase grains with a high HcJ became less.

Nevertheless, it was difficult to completely maintain the increase of HcJ derived from a large quantity of Co, Cu and Al and at the same time to further improve the HcJ derived from Dy. However, the HcJ increase derived from Dy could produce greater effect compared to the case that the raw alloy only contained Dy. The method for increasing HcJ by adding Dy and other elements was quite practical. Thus, the upper limits for Co, Cu and Al were respectively 1.10 mass %, 0.18 mass % and 0.40 mass %.

According to the present invention, an R-T-B based sintered magnet was provided in which HcJ was significantly increased by containing a relatively low amount of Dy. Further, an R-T-B based sintered magnet was obtained with sharply reducing amount of Dy and maintaining the conventional magnetic properties.

As mentioned above, the present invention provides an R-T-B based sintered magnet with maintaining high magnetic properties and decreasing usage amount of heavy rare earth elements.

DESCRIPTION OF REFERENCE NUMERALS

1 Main phase grain
2 Core portion
3 Shell portion
4 Maximum thickness of the shell portion

What is claimed is:

1. A R-T-B based sintered magnet, comprising:

main phase grains and grain boundary phases, said main phase grain contains a core portion and a shell portion, x in the main phase $LR_{(2-x)}HR_xT_{14}B$ of said core portion ranges from 0.00 to 0.07, x in the main phase $LR_{(2-x)}HR_xT_{14}B$ of said shell portion ranges from 0.02 to 0.40, and the maximum thickness of said shell portion is 7 nm to 100 nm, wherein, LR contains Nd, and optionally at least one light rare earth element selected from the group consisting of Y, La, Ce, Pr and Sm, HR contains Dy or/and Tb, and optionally at least one heavy rare earth element selected from the group consisting of Gd, Ho, Er, Tm, Yb and Lu, T contains Fe or/and Co, and optionally at least one element selected from the group consisting of Mn and Ni, B represents boron with part of it replaced by C (carbon), the R-T-B based sintered magnet containing 0.15 to 0.65 mass % of HR, and the concentration of HR in the core portion is lower than that in the shell portion.

2. The R-T-B based sintered magnet according to claim 1, wherein, in the grain boundary phase of the two-grain boundary of said main phase grains, R accounts for 10 to 30 at %, T accounts for 65 to 85 at %, Cu accounts for 0.70 to 4.0 at %, and Al accounts for 0.07 to 2.0 at %, R represents Y (yttrium) and one or two kinds of rare earth elements, and T represents one or two or more transition metals and contains Fe or the combination of Fe and Co as the essential.

3. The R-T-B based sintered magnet according to claim 2, wherein, the volume ratio of the core portion to the total main phase grain is 90.0% or more.

4. The R-T-B based sintered magnet according to claim 3, wherein, in the composition, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

5. The R-T-B based sintered magnet according to claim 2, wherein, in the composition, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

6. The R-T-B based sintered magnet according to claim 1, wherein, said LR is Nd or/and Pr, and HR is Dy or/and Tb.

7. The R-T-B based sintered magnet according to claim 6, wherein, in the composition, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

8. The R-T-B based sintered magnet according to claim 1, wherein, the volume ratio of the core portion to the total main phase grain is 90.0% or more.

9. The R-T-B based sintered magnet according to claim 8, wherein, in the composition, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

10. The R-T-B based sintered magnet according to claim 1, wherein, in the composition, LR accounts for 29.4 to 31.5 mass %, HR accounts for 0.15 to 0.65 mass %, Al accounts for 0.03 to 0.40 mass %, Co accounts for 0.03 to 1.10 mass %, Cu accounts for 0.03 to 0.18 mass %, B accounts for 0.75 to 1.25 mass %, and the balance is Fe.

11. The R-T-B based sintered magnet according to claim 1, wherein LR consists of Nd and Pr.

* * * * *